US011034512B2

(12) United States Patent
Krietzman

(10) Patent No.: US 11,034,512 B2
(45) Date of Patent: Jun. 15, 2021

(54) VOLUME CHANGING CONTAINER WITH EASY BAG REMOVAL

(71) Applicant: Mark H. Krietzman, Palos Verdes Estates, CA (US)

(72) Inventor: Mark H. Krietzman, Palos Verdes Estates, CA (US)

(73) Assignee: Dean Smart, Jonestown, TX (US)

( * ) Notice: Subject to any disclaimer, the term of this patent is extended or adjusted under 35 U.S.C. 154(b) by 140 days.

(21) Appl. No.: 15/666,492

(22) Filed: Aug. 1, 2017

(65) Prior Publication Data

US 2018/0162637 A1 Jun. 14, 2018

Related U.S. Application Data

(60) Provisional application No. 62/433,913, filed on Dec. 14, 2016.

(51) Int. Cl.
*B65F 1/06* (2006.01)
*B65F 1/16* (2006.01)

(52) U.S. Cl.
CPC ..... *B65F 1/068* (2013.01); *B65F 1/06* (2013.01); *B65F 1/1607* (2013.01); *B65F 1/1646* (2013.01)

(58) Field of Classification Search
CPC ..... B65F 1/068; B65F 1/06; B65F 1/1607; B65F 1/1646; B65F 1/12
USPC ..... 220/495.04, 230, 908, 908.1
See application file for complete search history.

(56) References Cited

U.S. PATENT DOCUMENTS 3,195,272 A * 7/1965 Mosher ..... A01G 9/026 47/73
4,054,225 A * 10/1977 Frech ..... B65F 1/06 220/495.04
4,765,579 A * 8/1988 Robbins, III ..... B65F 1/06 220/495.04
5,836,470 A * 11/1998 Neelly ..... B65F 1/06 220/4.22
6,283,321 B1 * 9/2001 Meshorer ..... B65F 1/06 220/4.22
7,909,200 B1 * 3/2011 Horne ..... B65F 1/06 220/495.08
2006/0283852 A1 * 12/2006 Greiner ..... B65F 1/06 220/4.22
2015/0375934 A1 * 12/2015 Reiser ..... B65F 1/068 53/474

* cited by examiner

*Primary Examiner* — James N Smalley
*Assistant Examiner* — Madison L Poos

(57) ABSTRACT

Disclosed herein is an ergonomic trash collection system and methods of a container with a floor. One or more flexure bearing region, hinge or living hinge, being formed in the container and or floor. In some instances one or more gaps or partial formed in the container wall(s) configured to support an asymmetrical separation of the walls along the gap.

8 Claims, 9 Drawing Sheets

VOLUME CHANGING CONTAINER WITH EASY BAG REMOVAL

RELATED APPLICATION

This application claims priority to United States ("U.S.") Provisional Patent Application Ser. No. 62/433,913 entitled ERGONOMIC TRASH CONTAINER WITH EASY BAG REMOVAL filed on Dec. 14, 2016, the disclosure of which is incorporated by reference herein in its entirety.

BACKGROUND OF THE DISCLOSURE

1. Field of the Disclosure

The present disclosure relates generally to trash receptacles and more specifically to trash receptacles with volume changing interiors via moving body wall(s).

2. Background

Removing a plastic trash bag from a trash container (or receptacle) may be impeded by an interface between the trash bag and the container friction, moister and/or a vacuum seal which forms between the plastic bag and at least one of the container's inside walls. Attempts to remove a filled trash bag from such a container are impeded by such interface between the bag and the container. The stickiness of the bag to the container may even cause the container to lift off the ground when the bag is lifted. This is particularly challenging for the young, elderly and infirm. The heavy bag or bags stuck in a container can cause back, shoulder and arm injury or strain.

Traditional trash containers 10 as shown in FIGS. 1A and 1B are know in the art to have a body 11 which is generally hollow sealed at a bottom 12 end and open at a top end 13. A top rim 14 may be fitted over the open top end 13 and the opening 15 of a flexible plastic trash bag 20 thus clamping or otherwise fixing the trash bag into the garbage container via the catch between the container and the optional rim.

If the plastic bag 20 is punctured or leaks refuse and waste 'W' may migrate via gravity down the plastic back and reside in the bottom 12 and to remove the refuse and residual smell one may wash the entire container. Washing a multiple gallon container includes lifting it and dumping out water one puts in it to clean it. The task is awkward and can be a physical obstacle. A filled ten to twelve gallon trash bag may hold upwards of 40 pounds depending on the thickness of the plastic bag.

Often a full plastic bag will impinge against the interior annular wall 27 of the container and one of hold the bag against the wall due to some deformation of a thin light weight plastic wall and at an interface 28 of container-bag formation of a temporary impediment between one or more walls of the container and the bag makes removal of the bag difficult. Moreover, if the container is lightweight a user trying to remove a bag that has formed a seal (FIG. 1B) often finds that the entire container lifts upward along the line of arrow 30. This seal connection between the bag and the container must be broken to remove the bag and that process can be physically challenging. A ten gallon plastic bag may contain upwards of twenty pounds of material. It is therefore a desideratum to reduce the foresaid failure of traditional bag and container waste disposal systems.

DISCLOSURE

In the following description of examples of implementations, reference is made to the accompanying drawings that form a part hereof, and which show, by way of illustration, specific implementations of the present disclosure that may be utilized. Other implementations may be utilized and structural changes may be made without departing from the scope of the present disclosure.

Disclosed herein are aspects of systems and methods of a volume changing trash container forming part of an ergonomic waste disposal system to reduce or eliminate plastic bag and container adherence and the problems associated therewith.

When a plastic trash bag adheres to the inner wall of a trash container the user may experience stress and strain when trying to separate the container and plastic bag. In the more extreme cases the user may lose balance when struggling with such an adherence. This is particularly problematic for older person or persons with instability. A loss of balance may cause the user to fall and become injured.

A four walled container having a floor wall, a back wall a first side wall and a second side wall each connected to the floor wall, each side wall is connected at one edge to the back wall; the end of the container opposite from the floor has a top edge; and a front wall with a bottom edge and top edge with a moving flexure means connecting the front wall to the floor. In some instances a rim which mates with the container top edge and the front wall top edge via a bag catch groove. In some instances a plastic bag is folded over the top edge.

Disclosed herein are aspects of systems and methods of a volume changing container having an annular wall formed as part of a floor; an open top at one end of the annular wall with a free edge; a gap running vertically in a first side wall "SEW" from the open top to the floor; a partial gap formed vertically in a second side wall "SEW" from the open top partially down the SEW; and, wherein the section of the SEW surrounding the partial gap bends inward without the container annular wall interfering with the bend at the partial gap when the gap is splayed apart. In some instances a removable plastic bag is placed inside the container with an open top folded over the free edge. In some instances a rim-cover configured to removably mate over the free edge of the open top and the plastic bag is utilized to thereby holding the plastic bag in place and limiting movement of the annular wall along the gap(s).

Disclosed herein are aspects of systems and methods of a volume changing container having an annular wall formed as part of a floor; an open top at one end of the annular wall with a free edge; a gap running vertically in a first side wall "SEW" from the open top to the floor; a "V" shaped partial gap is formed vertically in a second side wall "SEW" from the open top partially down the SEW; and, wherein the section of the SEW surrounding the partial gap bends inward without the container annular wall interfering with the bend at the partial gap when the gap is splayed apart. The partial gap has a widest top opening "PWD" at the top most portion of the "V" shape and a vertical length "1". In some instances the ratio of the "PWD" to the length "1" of the partial gap is less than 1:6.

Disclosed herein are aspects of systems and methods of a volume changing container having an annular wall formed as part of a floor; an open top at one end of the annular wall with a free edge; a gap running vertically in a first side wall "SEW" from the open top to the floor; a second flexure region is formed vertically in a second side wall "SEW" from the open top down the SEW; and, wherein the section of the SEW surrounding the second flexure bends inward without the container annular wall interfering with the bend at the partial gap when the gap is splayed apart.

Disclosed herein are aspects of systems and methods of a volume changing container having a first container half and a second container half; a floor connected at an interface to each container half; each container half has two vertical side edges; an open top region of the half containers; gaps formed between the side edges of the first and the second half containers; and, a flexure bearing region across the floor. Wherein one or both of the half containers are configured to rotate about the flexure bearing region to asymmetrically separate the gaps and in general open the top region.

Disclosed herein are aspects of systems and methods of an ergonomic trash collection system with a four walled container having a floor wall, a back wall a first side wall and a second side wall each connected to the floor wall, each side wall is connected at one edge to the back wall; the end of the container opposite from the floor has a top edge; and a front wall with a bottom edge and top edge with a moving flexure means connecting the front wall to the floor. The container includes a rim which mates with the container top edge and the front wall top edge via a bag catch groove which is also placed over a plastic bag folded over that top edge (holding the bag open). In some instances the flexure means is one of a hinge assembly and a living hinge. A magnetic closure assembly to reversible mate the front wall with the edges of the side walls may be added.

FIGURES

The invention may be better understood by referring to the following figures. The components in the figures are not necessarily to scale, emphasis instead being placed upon illustrating the principles of the invention. In the figures, like reference numerals designate corresponding parts throughout the different views.

All descriptions and callouts in the Figures and all content therein are hereby incorporated by this reference as if fully set forth herein.

FURTHER DISCLOSURE

Disclosed herein are aspects and exemplars of waste container or receptacle systems, devices and methods which provides for ergonomic removal of trash bags.

Disclosed herein are aspects and exemplars of waste container or receptacle systems, devices and methods allow safer removal of a trash bag.

Some exemplars teach a volume changing container with easy manufacturability. Manufacturability as a unitary part is innovative in the environment of plastic waste receptacles which are extremely pricey competitive. A single part, integrally molded, container which provides the benefits of safer ergonomic bag removal and may require less labor for production thus supporting domestic production at low cost. An integrated flexure system eliminates some gaps in a container associated with leaks to the area outside of the container.

Figure 1A:
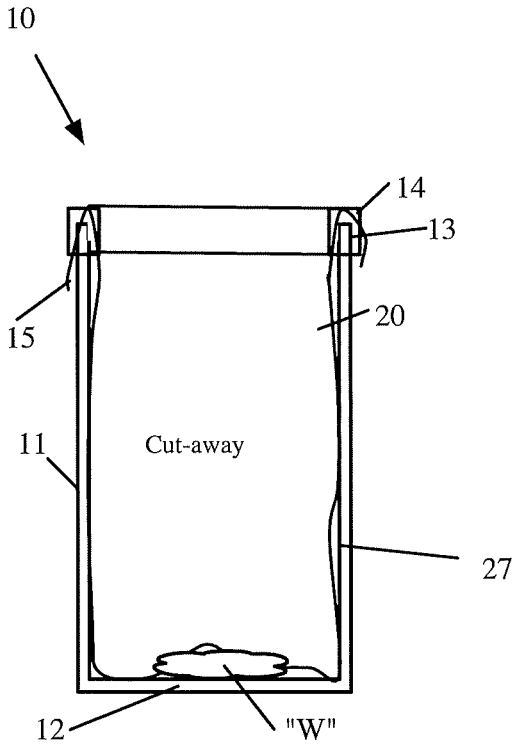
FIGS. 1A and 1B illustrate a traditional garbage receptacle.
Figure 1B:
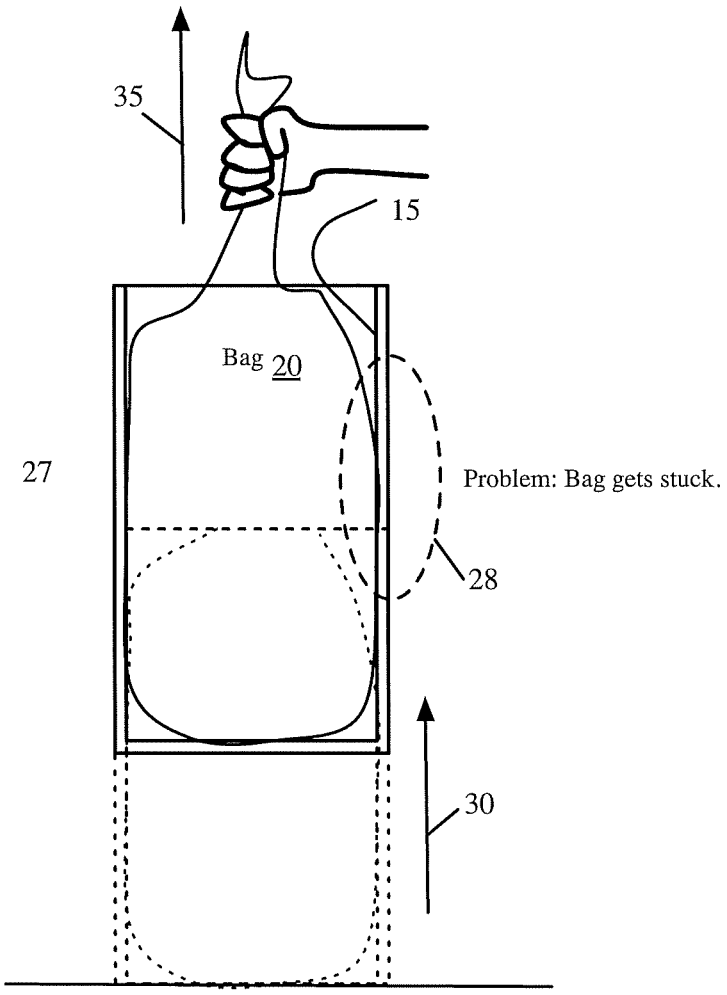
Figure 2A:
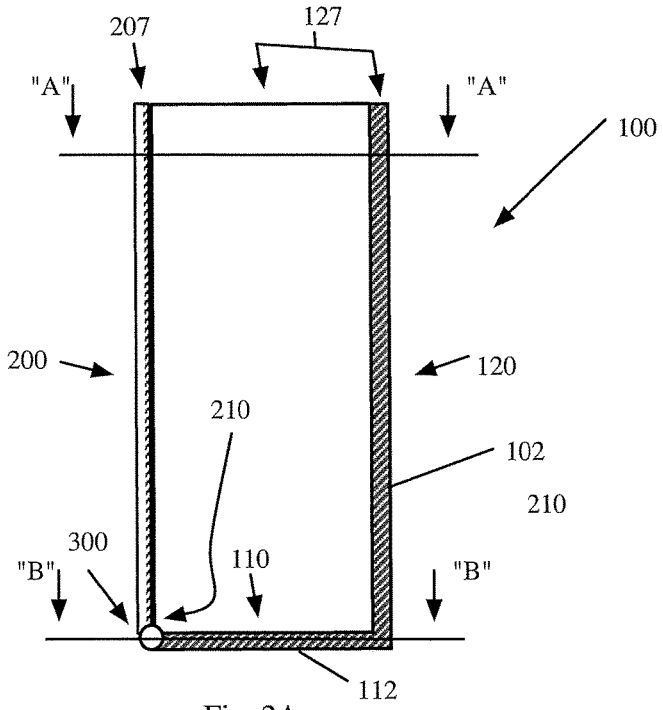
FIG. 2A illustrates a cut-away view of an ergonomic trash container.
Figure 2C:
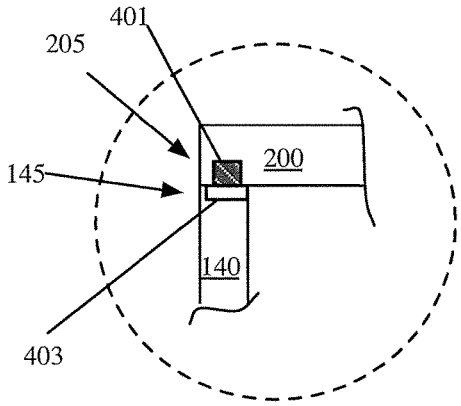
FIG. 2C illustrates an orthogonal view FIG. 2A along line B-B.
Figure 2B:
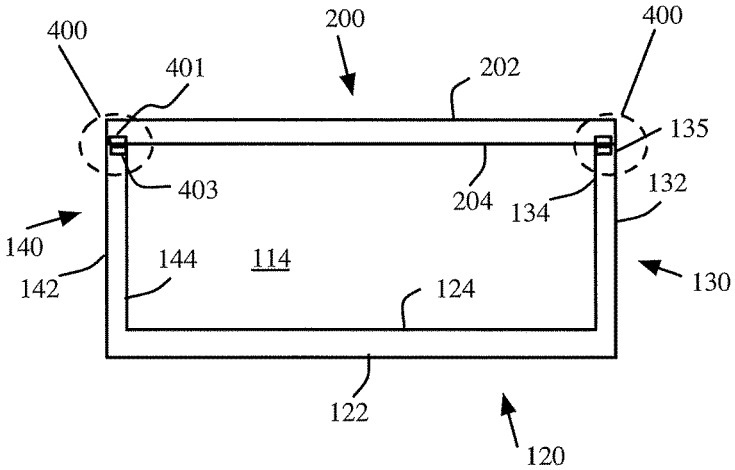
FIG. 2B illustrates an orthogonal view FIG. 2A along line A-A.

In some instance moving or splaying annular walls and/or portions of flexing or bending walls are configured to support release of a plastic trash bag from a container by altering the volume of said container. In other instances one or more moving wall with an attached or integral hinge or flexure are configured to support release of a plastic trash bag from a container by altering the volume of said container. In other instances a pair of split walls, each wall being bisected vertically, are formed opposite a integral hinge flexure in the bottom or floor of the container. In yet other instances a single bisected wall formed vertically in only one wall and in proximity to a flexure or living plastic hinge on the bottom or floor of the container can provide adequate FIGS. 2A-4 show aspects of exemplars of volume changing trash containers of the disclosure. The trash container 100 shown in FIGS. 2A-2C is formed from an open generally hollow four walled container 102 having a floor wall 110, a back wall 120, a first side wall 130 and a second side wall 140. A movable front wall 200 is attached to the floor 110 via a moving means 300.

The floor wall 110 has an exterior face 112 and an interior face 114. The side and back walls may be formed together as a unitary piece with the floor wall. The back wall 120 has an exterior face 122, an interior face 124 and a top edge 127; the first side wall 130 has an exterior face 132 an interior face, a free side edge 135 and a top edge 127; the second side wall 140 has an exterior face 142 an interior face 144, a free side edge 146, and a top edge 127. The movable front wall 200 has an exterior face 202 and an interior face 204 a two side edges 205, a top edge 207 and a bottom edge 210.

The front wall 200 is movable connected to the floor via a moving means 300. The moving means may be an interface which is integral to the floor and front wall or it may form an attachment between the floor and front wall. The means provides for angled or pivoting movement of the front wall relative to the floor. It is preferred that the movement defined by angle beta "β" is at least 5 degrees from vertical, it is more preferred that the movement is up to about 30 degrees from vertical and it is most preferred that the movement is about 90 degrees from vertical.

FIG. 2C shows a blown-up detail of the optional magnetic closure assembly 400 of FIG. 2B. A magnet or metallic insert 401 is affixed to the front wall near the side edge 205 and is aligned with a magnet or metallic insert 403 affixed to the free edge 145 of a side wall. Whereby the magnet and is attracted to the metallic insert. A metal that is attractive to magnetic forces is required. The closure may be used to close the front wall against the container 100 thereby making it easier to place the plastic bag 20 into the ergonomic container.

Figure 3A:
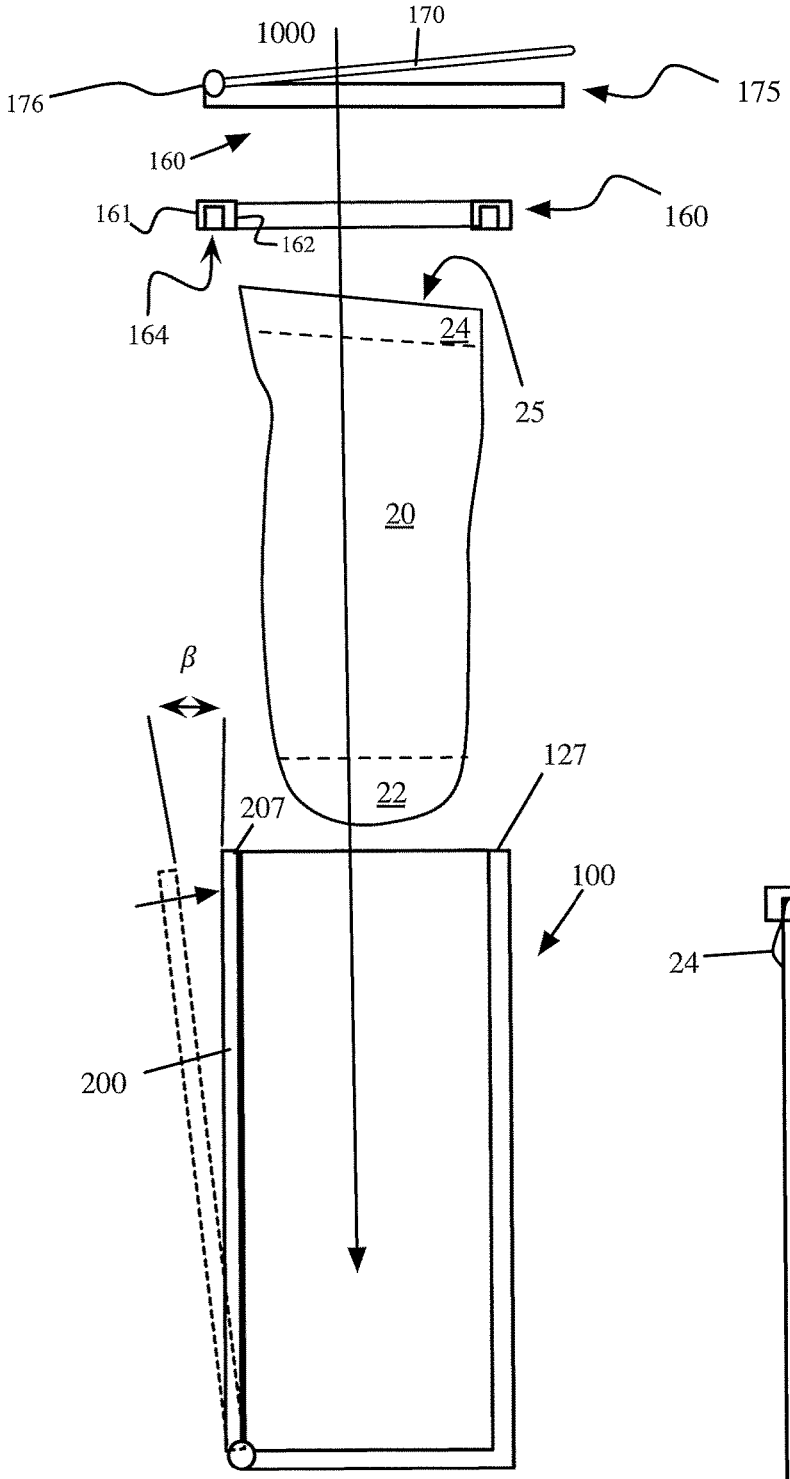
FIG. 3A illustrates an assembly view of an ergonomic trash container.
Figure 3B:
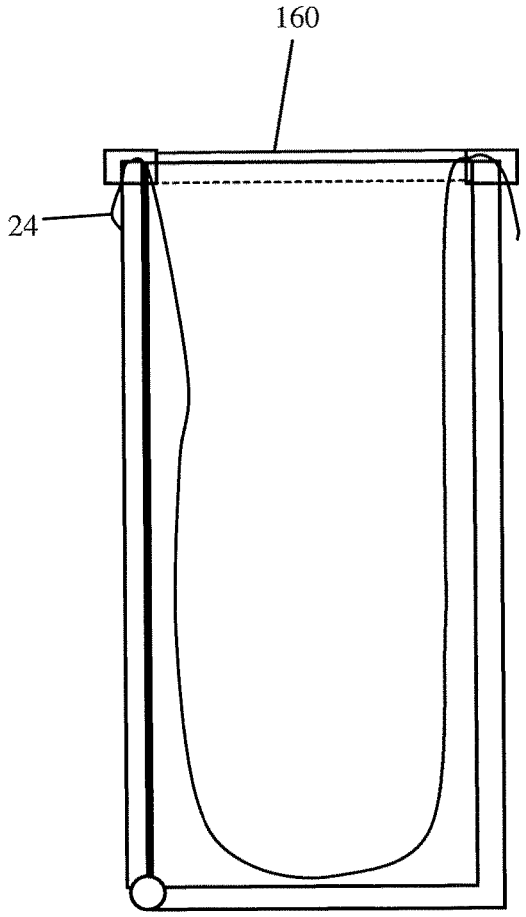
FIG. 3B illustrates the assembled view of FIG. 3.

FIGS. 3A and 3B illustrate the assembly and assembled of an ergonomic waste or trash container along the line of arrow 1000. During assembly the front wall 200 is closed against the container 100. A plastic trash bag 20 is inserted with its bottom section 22 inserted first and top section 24 is fluidly connected to the opening 25 of the bag. An optional rim may be added to help secure the bag. Additionally, a lid closure 170 may also be added to fit over the container or it may be integrated into the rim 160 forming a rim-cover 175. Such an integrated rim-cover will have a rotating means such as a hinge 176 to movably connect the lid closure 170 to the rim 160. Closures are well known in the art. The lid seals the container top. The rim may be a continuous channel with an outer annular wall 161 and inner annular wall 162 together forming a bag catch groove 164 formed on one side which shaped to mate with the top edges 127/207 of the container and moving front wall 200. The rim and the rim cover mate with the open top of the container whereby movement of the container wall(s) is restricted to prevent significant volume change.

The groove forms a catch which mates reversibly to pinch the top portion 24 of the plastic liner or bag 20 against the top edges and rim thereby keeping the open end 25 of said bag open. The rim 160 is not a limitation, bur rather one exemplary implementation. Those of ordinary skill in the art will understand that covers, collars, clips or other catches which can pinch at least a portion of the plastic bag against the top edges 107/207 are within the scope of the disclosure.

Between the removable exemplar rim 160 and the top edge there is provided sufficient gap to allow for temporary affixation and retention of a plastic trash bag 20 of between about 0.2 and about 8 mils via the top portion of the bag 24. More preferably between about 0.5 mils and about 3 mils.

Figure 4:
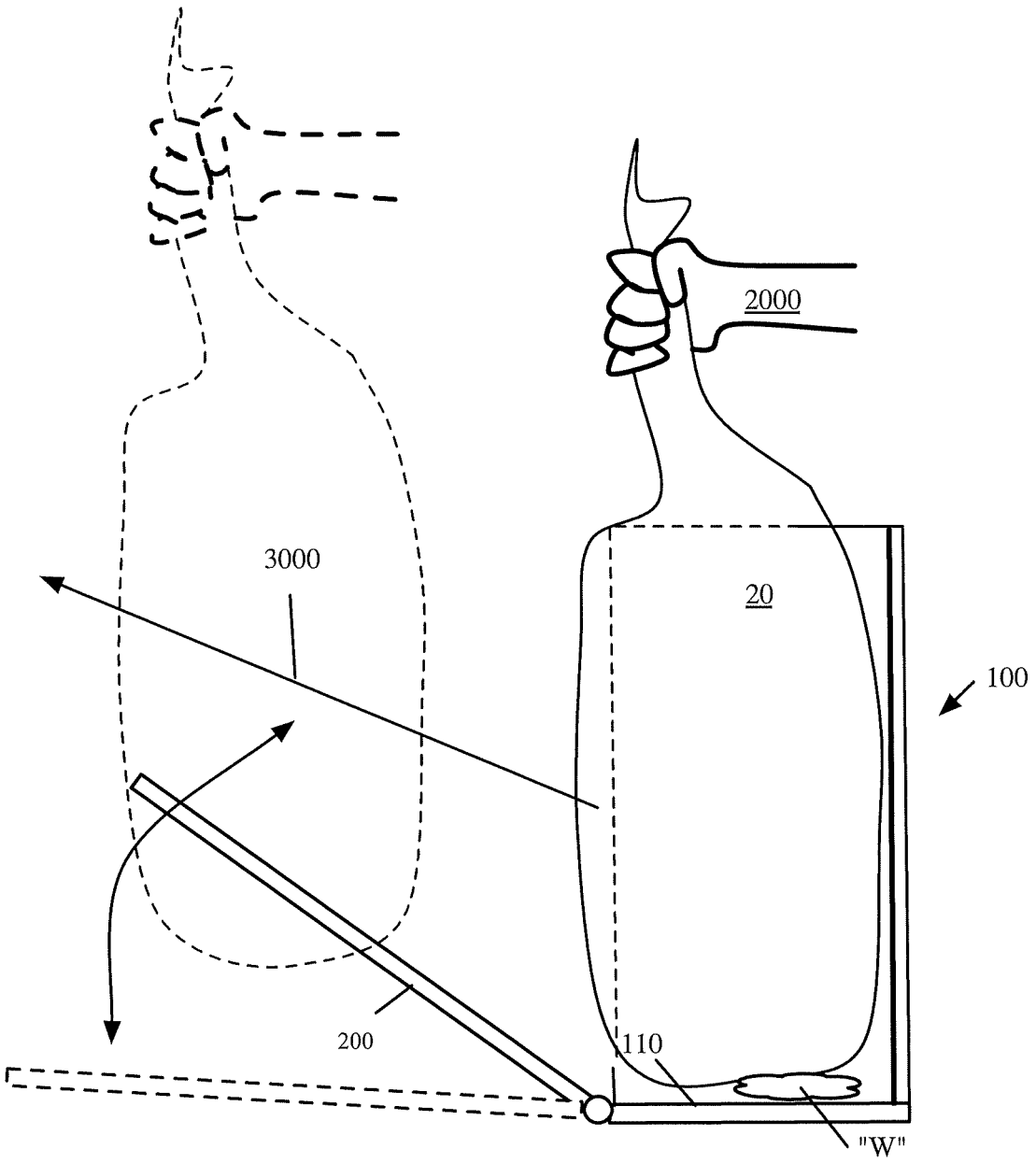
FIG. 4 illustrates the easy removal of a filled plastic bag from an ergonomic trash container.

FIG. 4 illustrates the back saving method of removing a filled trash bag 20 from the container. A user 2000 lifts the bag and moves it along the line of arrow 3000 in a generally horizontal movement with less vertical lift then removing a bag from a traditional trash container.

The moving front wall 200 simplifies access the floor wall 110. The movement of the wall changes the volume relationship between the container and the bag. In a close or restricted position the volume of the container is substantially fixed. As the plastic bag is filled that bag will press and/or adhere to the container as it occupies the volume. Moving the wall alters the relationship of the container volume by moving a wall to the bag. Although the bag may expand and vary to fill more of the container the impingement caused by the smaller volume of the container is reduced. In those instances when the plastic bag leaks it is important to have access to the floor to clean waste "W". The movable wall eliminates the need fro a user to reach down into a closed container such as a traditional waste container.

Figure 5A:
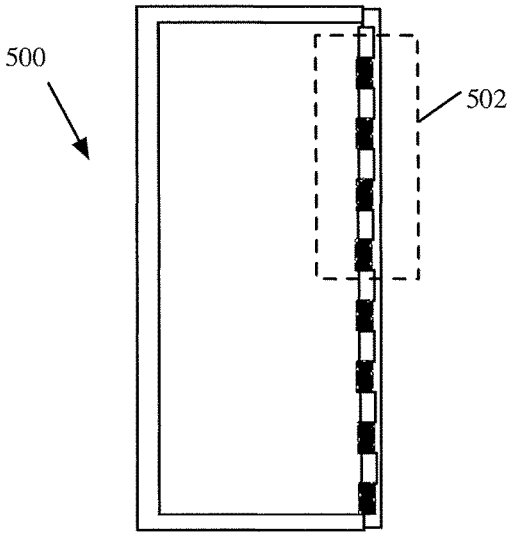
FIGS. 5A-5B illustrate aspects of a front wall hinge assembly of an ergonomic trash container.
Figure 5B:
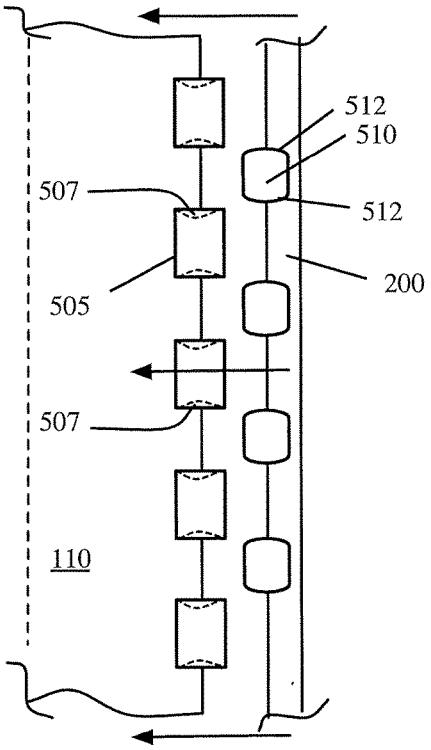

FIGS. 5A and 5B illustrate a hinge assembly on a container 500 which provides for the movement of the movable front wall. The assembly 502 is a snap together hinge formed of the same plastic as the molded container and front wall. The floor wall 110 contains a series of catches 505 which receive a series of latches 510 formed on the bottom edge of the front wall. Those of ordinary skill in the art will recognize that the catches and latches may be reversed from floor to front wall without departing from the scope of the disclosure. Each catch has receivers 507 on its ends end to receive corresponding connection interfaces 512.

Figure 6A:
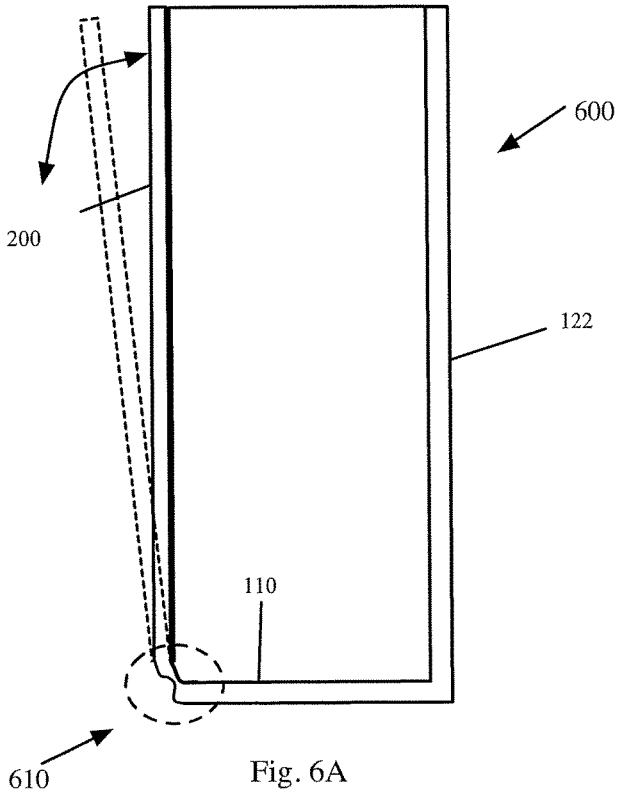
FIGS. 6A-6B illustrate aspects of a living hinge flexure of an ergonomic trash container.
Figure 6B:
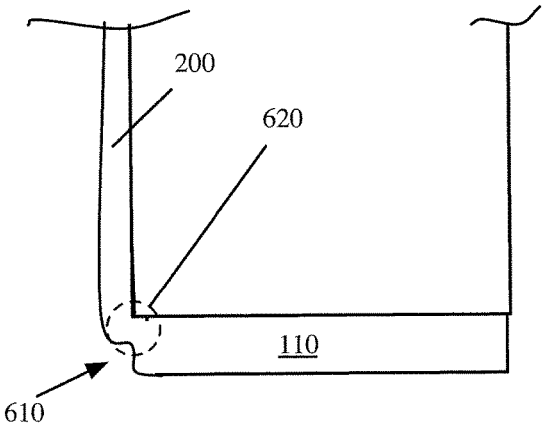

FIGS. 6A and 6B illustrate a container 600 with a flexure region of plastic. The flexure may be a thinner zone or region that is a purposefully less rigid area also known as a "living hinge" which is a planned bend area and it is integral to the container and need not be an attached piece. A flexure bearing region 610 which may be a living hinge is made from the same material as the two pieces it connects and it may be formed at the same time as the molded portions it is integrally formed as part of. In the exemplary implementation of FIG. 6A the floor wall 110 and the moving front wall 200 are formed with the same molding process and the region that is the flexure is also formed at the same time. Polyethylene and polypropylene are often considered to be the best resins for living hinges, due to their fatigue resistance. Living hinges (also known as integral hinges) in a plastic part can be defined as thin section 620 forming a flexible part that connects two relatively rigid adjacent wall sections. They can be injection molded, extruded or produced downstream via machining or stamping. The most durable of the three types by far is hinges produced by injection molding a homo-polymer of polypropylene.

FIGS. 7A through 7E illustrate a container 700 with a flexure region. The flexure may be a thinner zone or region that is a purposefully less rigid area also known as a "living hinge" which is a area of least resistance to be a pre-planned bend area also, in this instance, integral to the container. It is however within the scope of the disclosure, and those of ordinary skill in the art will understand that a separate hinge or flexure region may be mounted between the container halves to act as the integral flexure shown. The flexure bearing region is the bridge between the first container half. The first and second container halves are formed as part of or connected to, via an interface 705, a floor 710 and the second container half 712B. A gap is formed between the side edges 718 of each half container. The top view (FIG. 7C) shows a pair of gaps 715A and 715B between two half containers. The gaps spans vertically from the open top region 720 of the container to the floor 710 of the container. A base 722 to raise the container, may be added to the bottom 721 of the floor 710 of the container.

Figure 7A:
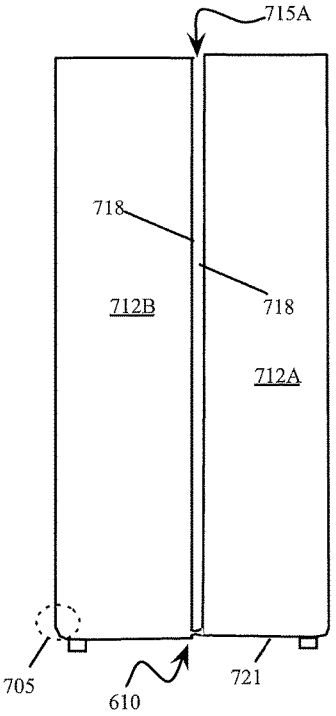
FIGS. 7A-7E illustrates aspects of a split container with an integral living hinge flexure of an ergonomic trash container.
Figure 7B:
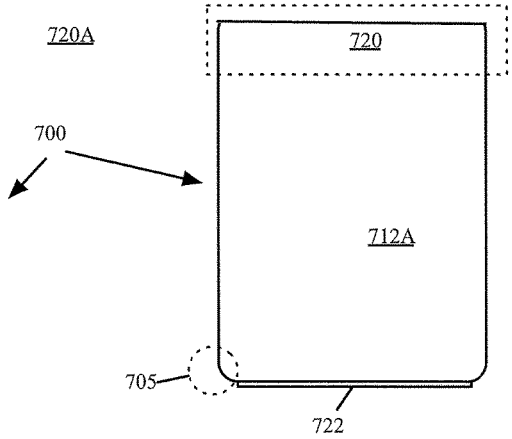
Figure 7C:
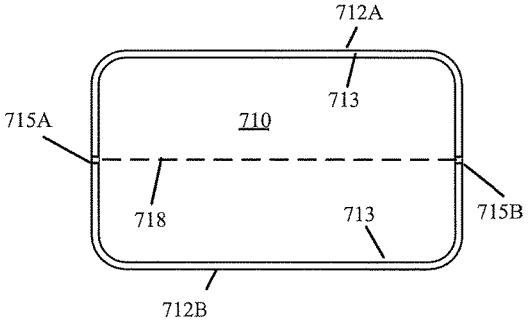
Figure 7D:
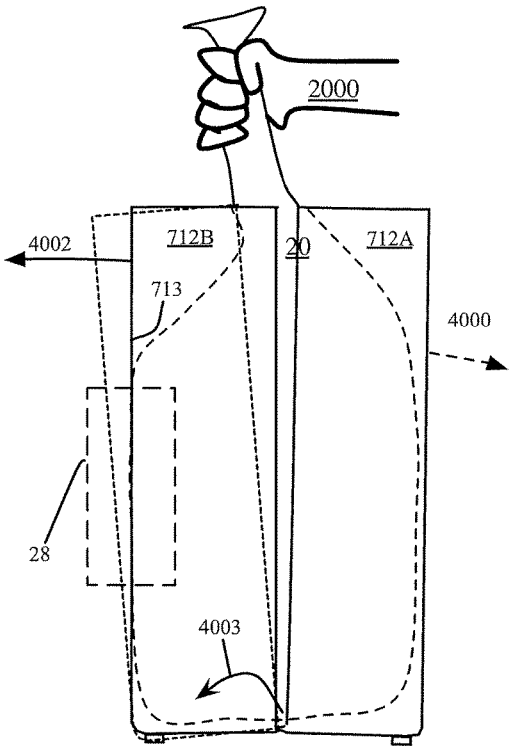
Figure 7E:
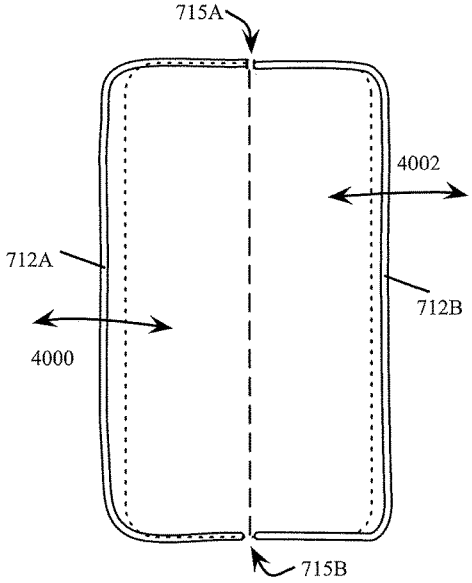

During usage a plastic bag 20 is placed in the container with its top portion 24 (shown in FIG. 3B) folded over the open top region 720. To remove the bag 20 the user 2000 moves the half containers apart. The movement is via a pivot of along one or both of the arrows 4000 and 4002. The movement of the first half container 712A and the second half container 712B alters the volume relationship of the container to the plastic bag and reduces impingement of the plastic bag against the interior wall 713 of one or both of the half containers which can hold the bag against the wall due to some deformation of the thin light weight plastic wall shown as interface 28. FIG. 7E is a top view showing the movement of the half containers 712A and 712B from a first position to a second position. Said movement is facilitated by the grasping at least one of the half containers and the movement of at east a portion of one half container along the line of arrow 4000 of 4002 and rotating at least one half container along the flexure bearing as shown by arrow 4003. That rotation asymmetrically separates the gap. In a closed first position wherein the rim is mated with the container the gaps are substantially defined by parallel edges. When the rim is removed and the containers separated the gaps are asymmetrically spread apart with a larger gap opening at the top region 720 of the container.

Figure 8A:
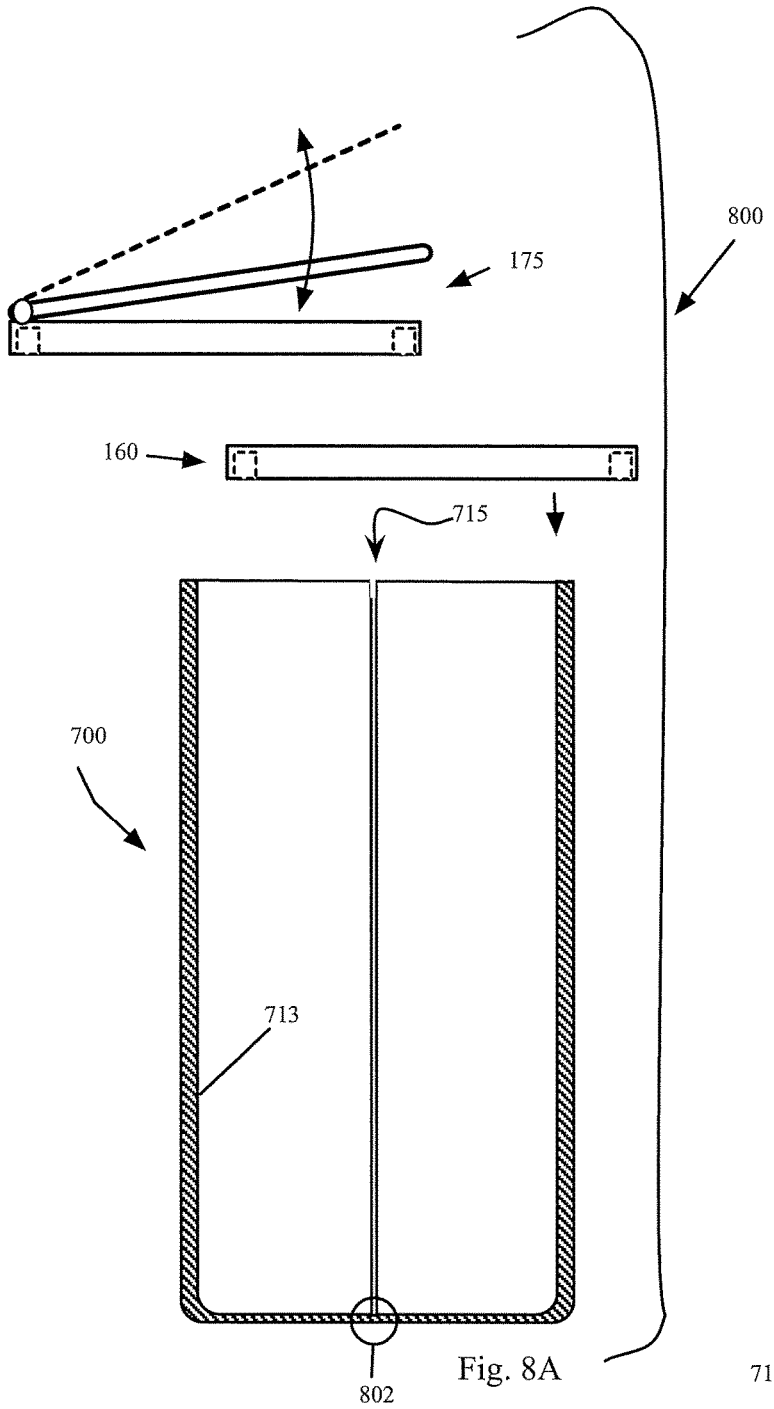
FIGS. 8A-8B illustrates aspects of a split container with an integral living hinge flexure of an ergonomic trash container and one or two vertical wall splits.
Figure 8B:
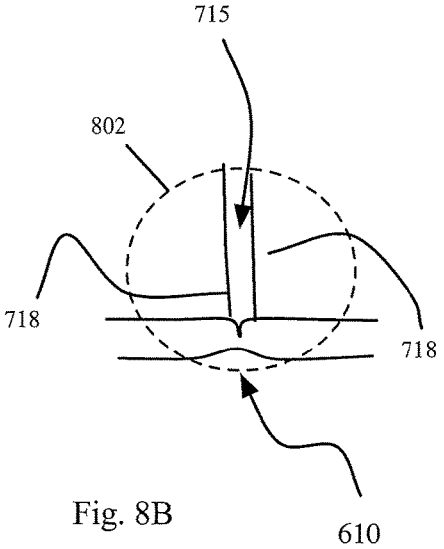

FIGS. 8A and 8B illustrate a waste receptacle system 800. The system has a container 700 with a flexure region connected to one of a rim 160 around the top edge or a rim cover 175 which includes a lid. FIG. 8B is a close up of area 802 of FIG. 8A showing greater detail of the flexure 610.

Figure 9A:
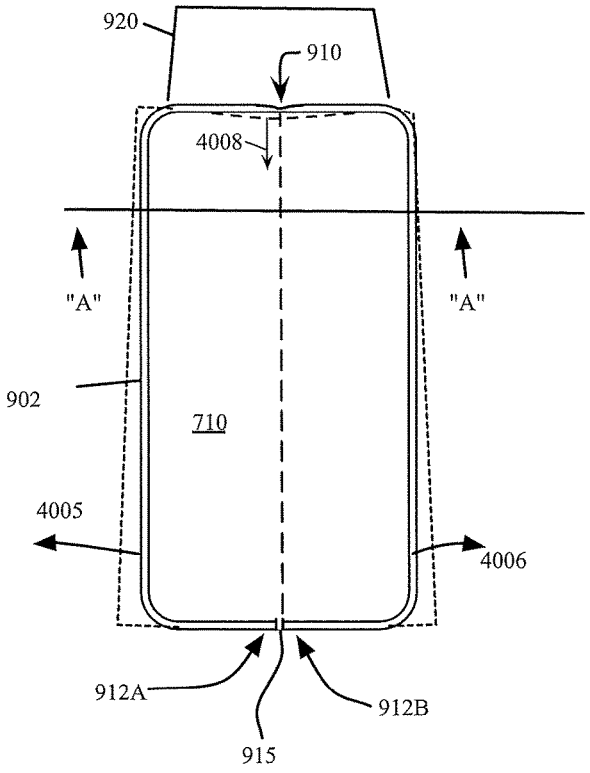
FIGS. 9A-9B illustrates aspects of a split container with an integral living hinge flexure of an ergonomic trash container; and, FIGS. 10A-10D illustrates aspects of a split container with a full split end wall and a partial split end wall of an ergonomic trash container.
Figure 9B:
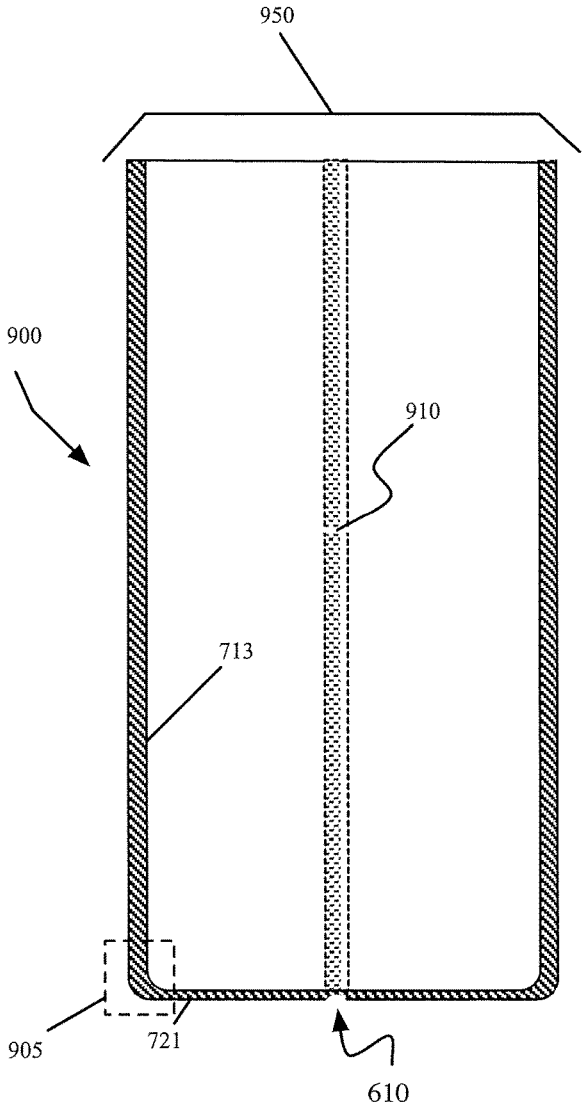

FIGS. 9A and 9B illustrate a container with at least dual flexure regions. Each flexure being a living hinge or the like as previously described herein. FIG. 9B is a cut-away view of FIG. 9A along the line of arrow A-A. The container 900 is comprised of a floor 710 and an annular wall 902 which is connected to or form as part of the floor at a lower area 905. The annular wall is broken via a vertical gap 915. There is a first wall edge 912A and a second wall edge 912B on either side of the gap 915. The flexure bearing region 610 is formed across the floor and it may be aligned with each of the gaps. This implementation operates by splaying apart the annular wall 902 via urging the gap apart along the line of arrows 4005 and 4006 a second flexure region 910 is formed on the annular wall allowing a section 920 of that annular wall to bend inward along the line of arrow 4008 in response to the splaying of the gap. The splaying is more pronounced near the open top 950. This exaggeration of the gap opening near the open top 950 results from the annual wall and floor connections at the lower area 905 which restricts the gap opening bear the bottom of the vertical gap 915. The open top begins at the free edge 952 of the annular wall.

FIG. 10A through 10D illustrate aspects of an exemplary implementation of a split container with ergonomic bag removal properties.

Figure 10A:
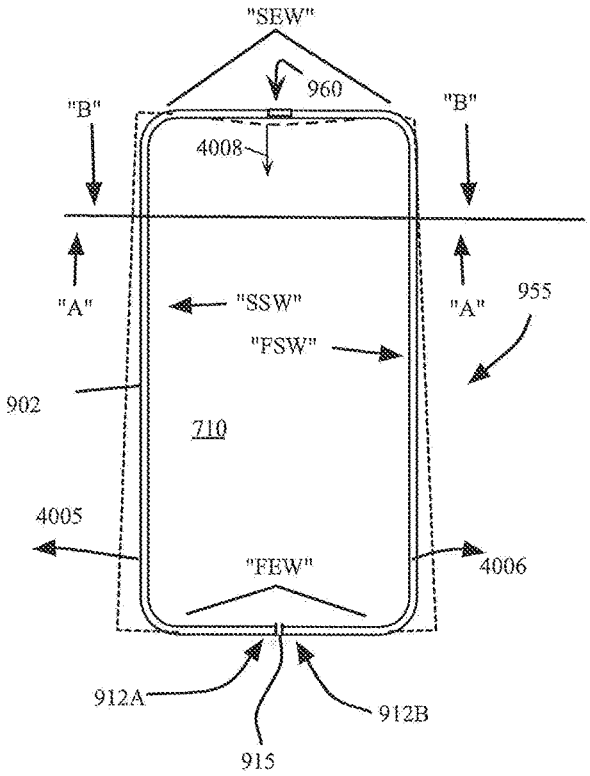

FIG. 10A is a top view of a container 955 with the optional cover removed. The container 900 is comprised of a floor 710 and an annular wall 902 which is connected to or form as part of the floor at a lower area 905. The annular wall is broken via a vertical gap 915 in the first end wall "FEW". Also illustrated is a first wall edge 912A and a second wall edge 912B on either side of the gap 915. The annular wall is partially broken in the second end wall "SEW".

Figure 10C:
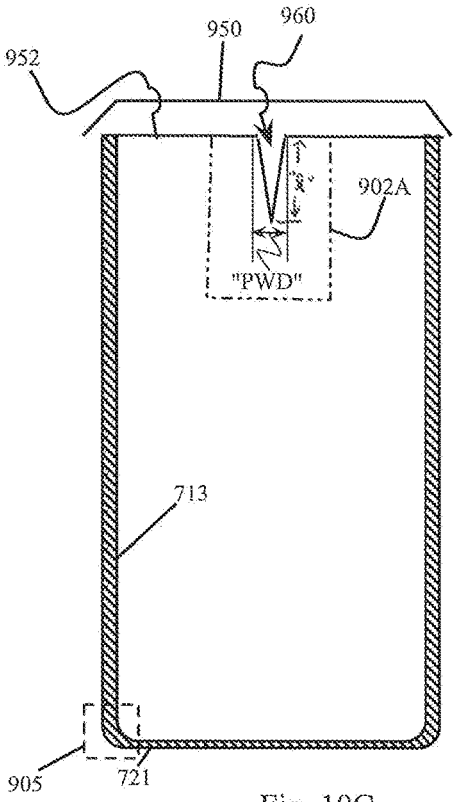
Figure 10B:
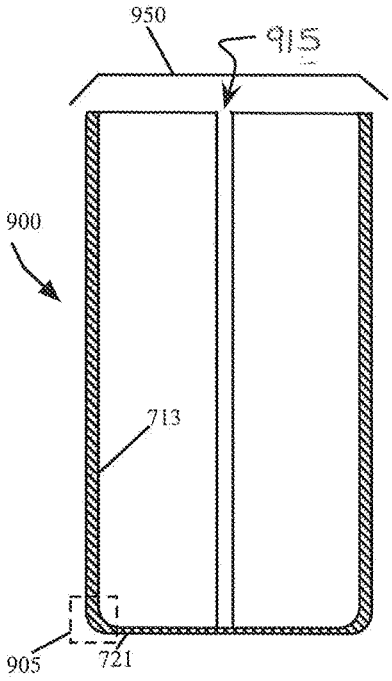

FIG. 10B shows a cut-away view along the line of arrow "A"-"A" looking towards the "FEW" through the container, the gap 915 is visible. The container is splayed along the line of arrows 4005 and 4006 when the user moves or splays the container apart via the first wall edge 912A and the second wall edge 912B.

FIG. 10C shows a cut-away view along the line of arrow "B"-"B" looking towards the "SEW" through the container, the partial gap 960 is formed near the open top 950. In this exemplar a flexing region is the section of the "SEW" 902A surrounding the partial gap. The partial gap 960 is illustrated as "V" shaped with a widest top opening designated "PWD" at the top of the "V" which is at the free edge 952 and a decreasing opening as it approaches and terminates at the bottom portion of the "V". A "V" shape is not mandatory and those of ordinary skill in the art will recognize that a variety of non-parallel partial gap openings will function to buffer impingement of the annular wall against itself during splaying at the gap. The splaying refers to an asymmetrical separation of a gap which was generally parallel before splaying. The widest portion of the partial gap opening "PWD" is important to allow for free movement of the top most portion of the free edge to bend or fold inward (along the line of arrow 4008) in response to the splay of the annular wall about the gap 915. The ratio of the "PWD" to the length "1" of the partial gap is preferably less than 1:6, more preferably less than 1:4 and most preferable less than 1:3.

The partial gap provides for a flexing wall region that is formed due to the reduction in integrity of the section 902A due to the partial gap. Accordingly that section of "SEW" will bend inward along the line of arrow 4008 during the splaying of the gap 915 in the "FEW" without the container wall around the flexing section 902A interfering with the bend inward.

Figure 10D:
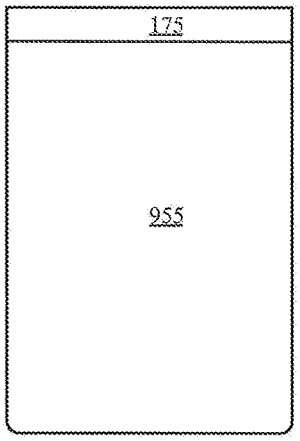

FIG. 10D shows the container 955 with a rim-cover 175 attached thereto. The rim-cover restrains the movement of the annular wall (due to the gap and partial gap) during refuge collection. When the rim-cover is removed the splaying method allows a user to alter and otherwise change the container volume and temporarily relieve the forces which cause the plastic bag to press against and adhere thereto.

While the method and agent have been described in terms of what are presently considered to be the most practical implementations and aspects thereof, it is to be understood that the disclosure need not be limited to the disclosed implementations, aspects or order and/or sequence of combination of aspects. It is intended to cover various modifications and similar arrangements included within the spirit and scope of the claims, the scope of which should be accorded the broadest interpretation so as to encompass all such modifications and similar structures. The present disclosure includes any and all implementations of the following claims.

It should also be understood that a variety of changes may be made without departing from the essence of the disclosure. Such changes are also implicitly included in the description. They still fall within the scope of this disclosure. It should be understood that this disclosure is intended to yield a patent covering numerous aspects both independently and as an overall system and in both method and apparatus modes.

Further, each of the various elements of the disclosure and claims may also be achieved in a variety of manners. This disclosure should be understood to encompass each such variation, be it a variation of an implementation of any apparatus implementation, a method or process implementation, or even merely a variation of any element of these.

Particularly, it should be understood that as the disclosure relates to elements of the implementation, the words for each element may be expressed by equivalent apparatus terms or method terms—even if only the function or result is the same.

Such equivalent, broader, or even more generic terms should be considered to be encompassed in the description of each element or action. Such terms can be substituted where desired to make explicit the implicitly broad coverage to which this disclosure is entitled.

It should be understood that all actions may be expressed as a means for taking that action or as an element which causes that action.

Similarly, each physical element disclosed should be understood to encompass a disclosure of the action which that physical element facilitates.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans and the Random House Webster's Unabridged Dictionary, latest edition are hereby incorporated by reference.

Finally, all referenced listed in the Information Disclosure Statement or other information statement filed with the application are hereby appended and hereby incorporated by reference; however, as to each of the above, to the extent that such information or statements incorporated by reference might be considered inconsistent with the patenting, such statements are expressly not to be considered as made by the applicant(s).

In this regard it should be understood that for practical reasons and so as to avoid adding potentially hundreds of claims, the applicant has presented claims with initial dependencies only.

Support should be understood to exist to the degree required under new matter laws—including but not limited to United States Patent Law 35 USC 132 or other such laws—to permit the addition of any of the various dependencies or other elements presented under one independent claim or concept as dependencies or elements under any other independent claim or concept.

To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternatives.

Further, the use of the transitional phrase "comprising" is used to maintain the "open-end" claims herein, according to traditional claim interpretation. Thus, unless the context requires otherwise, it should be understood that the term "compromise" or variations such as "comprises" or "comprising", are intended to imply the inclusion of a stated element or step or group of elements or steps but not the exclusion of any other element or step or group of elements or steps. Such terms should be interpreted in their most expansive forms so as to afford the applicant the broadest coverage legally permissible. All callouts associated with figures are hereby incorporated by this reference.

Since certain changes may be made in the above system, method, process and or apparatus without departing from the scope of the disclosure herein involved, it is intended that all matter contained in the above description, as shown in the accompanying drawing, shall be interpreted in an illustrative, and not a limiting sense.

It will be understood that various aspects or details of the disclosures may be changed combined, or removed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

What is claimed is:

1. A volume changing container comprising:

an annular wall (902) formed as part of a floor (710);

an open top (950) at one end of the annular wall with a free edge (952); a gap (915) running vertically in a first side wall "SEW" from the open top to the floor;

a second flexure region (910) is formed vertically in a second side wall "SEW" from the open top down the SEW; and, wherein the section of the SEW (902A) surrounding the partial gap bends inward (4008) without the container annular wall interfering with the bend at the partial gap when the gap is splayed apart.

2. The volume changing container of claim 1 further comprising a removable plastic bag placed inside the container with an open top folded over the free edge.

3. The volume changing container of claim 2 further comprising a rim-cover (175) configured to removably mate over the free edge of the open top and the plastic bag thereby holding the plastic bag in place and limiting movement of the annular wall along the gap(s).

4. The volume changing container of claim 1 further comprising a flexure bearing region (610) formed integrally in the floor wall (710); and, wherein the flexure bearing region (610) is across the floor wall (710) between the gap and second flexure region.

5. The volume changing container of claim 1 further comprising a base (722).

6. A volume changing ergonomic trash collection system comprising:

a four walled container (102) with a floor wall (110), a back wall (120) a first side wall (130) and a second side wall (140) each connected to the floor wall, each side wall is connected at one edge to the back wall; the end of the container opposite from the floor has a top edge (127);

a front wall with a bottom edge (210) and top edge (207); and, a moving flexure means (300) connecting the front wall to the floor by way of an integral wall thin section (620) constructed as a single piece forming the front wall with the floor wall; and, wherein the living hinge formed by the thin section is configured to be a flexure bearing region (610).

7. The ergonomic trash collection system of claim 6 further comprising a rim which mates with the container top edge and the front wall top edge via a bag catch groove (164).

8. The ergonomic trash collection system of claim 7 further comprising a plastic bag folded over the top edge and held in place by the rim.

* * * * *